US006699047B1

(12) United States Patent
McHugh et al.

(10) Patent No.: US 6,699,047 B1
(45) Date of Patent: Mar. 2, 2004

(54) ELECTRICAL CONNECTOR WITH RETENTION PROTRUSIONS

(75) Inventors: Robert G. McHugh, Golden, CO (US); Fang-Jwu Liao, Tu-chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/335,422

(22) Filed: Dec. 30, 2002

(51) Int. Cl.[7] ..... H01R 12/00
(52) U.S. Cl. ..... 439/71; 439/330; 439/331
(58) Field of Search ..... 439/330, 331, 439/70, 71; 174/263

(56) References Cited

U.S. PATENT DOCUMENTS 4,164,003 A * 8/1979 Cutchaw ..... 361/771
5,833,472 A * 11/1998 Bright ..... 439/70

* cited by examiner

*Primary Examiner*—Dean A. Reichard
*Assistant Examiner*—Jinhee Lee
(74) *Attorney, Agent, or Firm*—Wei Te Chung

(57) ABSTRACT

An electrical connector (1) for connecting a land grid array (LGA) chip (2) with a printed circuit board includes an insulative housing (12), a frame (11) engaged with the housing, and a plurality of terminals (13) received in the housing. The housing defines two adjacent sides (122, 123). A plurality of arcuate protrusions (1220, 1230) is formed on said sides. The frame has four sidewalls (110, 113, 114, 115) defining a central cavity (111) therebetween for receiving the LGA chip therein. Two adjacent of the sidewalls define a plurality of cutouts (1110, 1130) in respective inner faces thereof, corresponding to the protrusions respectively. The frame is mounted on the housing, with the protrusions being engagingly received in the corresponding cutouts. When the LGA chip is engaged with the connector, the protrusions elastically deform to accurately guide and securely fix the LGA chip in the connector.

10 Claims, 5 Drawing Sheets

ELECTRICAL CONNECTOR WITH RETENTION PROTRUSIONS

BACKGROUND OF THE INVENTION

1. Field of the Invention

The present invention relates to an electrical connector for electrically connecting an electronic package such as a land grid array (LGA) chip with a circuit substrate such as a printed circuit board (PCB), and particularly to an electrical connector with improved retention protrusions for conveniently and securely positioning an LGA chip in the electrical connector.

2. Description of the Prior Art

Land grid array (LGA) electrical connectors are widely used in the connector industry for electrically connecting LGA chips to printed circuit boards (PCBs) in personal computers (PCs). Details are provided in "Nonlinear Analysis Helps Design LGA Connectors" (Connector Specifier, February 2001, pp. 18–20). Conventionally, one kind of the LGA connector mainly comprises an insulative housing, a multiplicity of terminals received therein, and a load plate and a cam lever pivotably mounting on two opposite sides of the housing. The housing defines a multiplicity of terminal passageways in a rectangular array, for interferentially receiving corresponding terminals. Due to the very high density of the terminal array which an LGA chip may have, the LGA chip needs to be precisely seated on the LGA connector. This is to ensure reliable signal transmission between the terminals and the LGA chip. For example, means for accurately attaching an LGA chip to an LGA connector are disclosed in U.S. Pat. Nos. 4,504,105 and 4,692,790.

Referring to FIG. 5, a conventional LGA connector 6 comprises an insulative housing 60, a multiplicity of terminals 61 received in the housing 60, and a load plate 62 and a cam lever 63 pivotably mounted on two opposite sides of the housing 60. The load plate 62 defines a channel 620 receiving the cam lever 63. To mount an LGA chip (not shown) on the LGA connector 6, the load plate 62 is rotated up until it is perpendicular to the housing 60. The LGA chip is seated in the housing 60, and is loosely engaged with the terminals 61. The load plate 62 is rotated down so that it rests on the LGA chip. The cam lever 63 is rotated down until it engages in the channel 620 of the load plate 62. When the cam lever 63 has reached the end of its travel, the load plate 62 presses the LGA chip into firm engagement with the terminals 61 of the connector 6.

In the above-described assembly process, the load plate 62 presses the LGA chip between two opposite sides of the housing 60 of the connector 6. Generally, a material of the housing 60 is not resilient, and the sides of the housing 60 can not elastically deform under pressure from the LGA chip. If the LGA chip is narrower than a distance between the opposite sides of the housing 60, the LGA chip may be poorly positioned relative to the terminals 61. This can adversely affect mechanical and electrical connection between the LGA chip and the connector 6. If the LGA chip is wider than a distance between the opposite sides of the housing 60, the housing 60 is liable to break. Furthermore, when the load plate 62 presses the LGA chip to firmly engage with the terminals 61, the housing 60 is liable to break if asymmetrical force is inadvertently applied thereto.

FIG. 6 shows another conventional LGA connector 6' devised to overcome the above-described problem. The connector 6' comprises an insulative housing 60', and a multiplicity of terminals 61' received therein. In forming the connector 6', a carrier strip (not shown) is used. The carrier strip comprises a row of the terminals 61', and a row of connecting sections (not shown) respectively connecting the terminals 61' with a main body of the carrier strip. The housing 60' comprises four raised sidewalls 62', and a flat base 63' disposed between the sidewalls 62'. The base 63' and the sidewalls 62' cooperatively define a space therebetween for receiving an LGA chip (not shown) therein. The base 63' defines a multiplicity of terminal passageways 64' for receiving the terminals 61' therein. When the LGA chip is seated on the LGA connector 6', the four sidewalls 62' can securely engage the LGA chip therebetween.

However, installation of terminals 61' into those passageways 64 near two of the sidewalls 62' is problematic. Once the terminals 61' have been inserted into such passageways 64', the connecting sections of the carrier strip must be cut from their corresponding terminals 61'. Because the carrier strip is located close to the relevant sidewall 62', there is insufficient space to manipulate the carrier strip to allow easy cutting off of the connecting sections. Such manipulation is blocked by the sidewall 62, which is liable to sustain damage as a result.

Therefore, a new LGA electrical connector which overcomes the above-mentioned problems is desired.

SUMMARY OF THE INVENTION

An object of the present invention is to provide an electrical connector for electrically connecting an electronic package such as a land grid array (LGA) chip with a circuit substrate such as a printed circuit board (PCB), whereby the electrical connector can quickly and conveniently guide the LGA chip into its correct position.

Another object of the present invention is to provide an electrical connector having means for accurately positioning an electronic package such as an LGA chip thereon, whereby manufacturing and transportation costs of the electrical connector are reduced.

To achieve the above objects, an electrical connector in accordance with a preferred embodiment of the present invention is for connecting an LGA chip with a PCB. The connector includes an insulative housing, a frame engaged with the housing, and a plurality of terminals received in the housing. The housing defines four sides. A plurality of arcuate protrusions is formed on two adjacent of the sides. The frame has four sidewalls defining a central cavity therebetween for receiving the LGA chip therein. Two adjacent of the sidewalls define a plurality of cutouts in respective inner faces thereof, corresponding to the protrusions respectively. The frame is mounted on the housing, with the protrusions being engagingly received in the corresponding cutouts. When the LGA chip is engaged with the connector, the protrusions elastically deform to accurately guide and securely fix the LGA chip in the connector.

Other objects, advantages and novel features of the invention will become more apparent from the following detailed description when taken in conjunction with the accompanying drawings, in which:

DESCRIPTION OF THE PREFERRED EMBODIMENT

Reference will now be made to the drawings to describe the present invention in detail.

Figure 1:
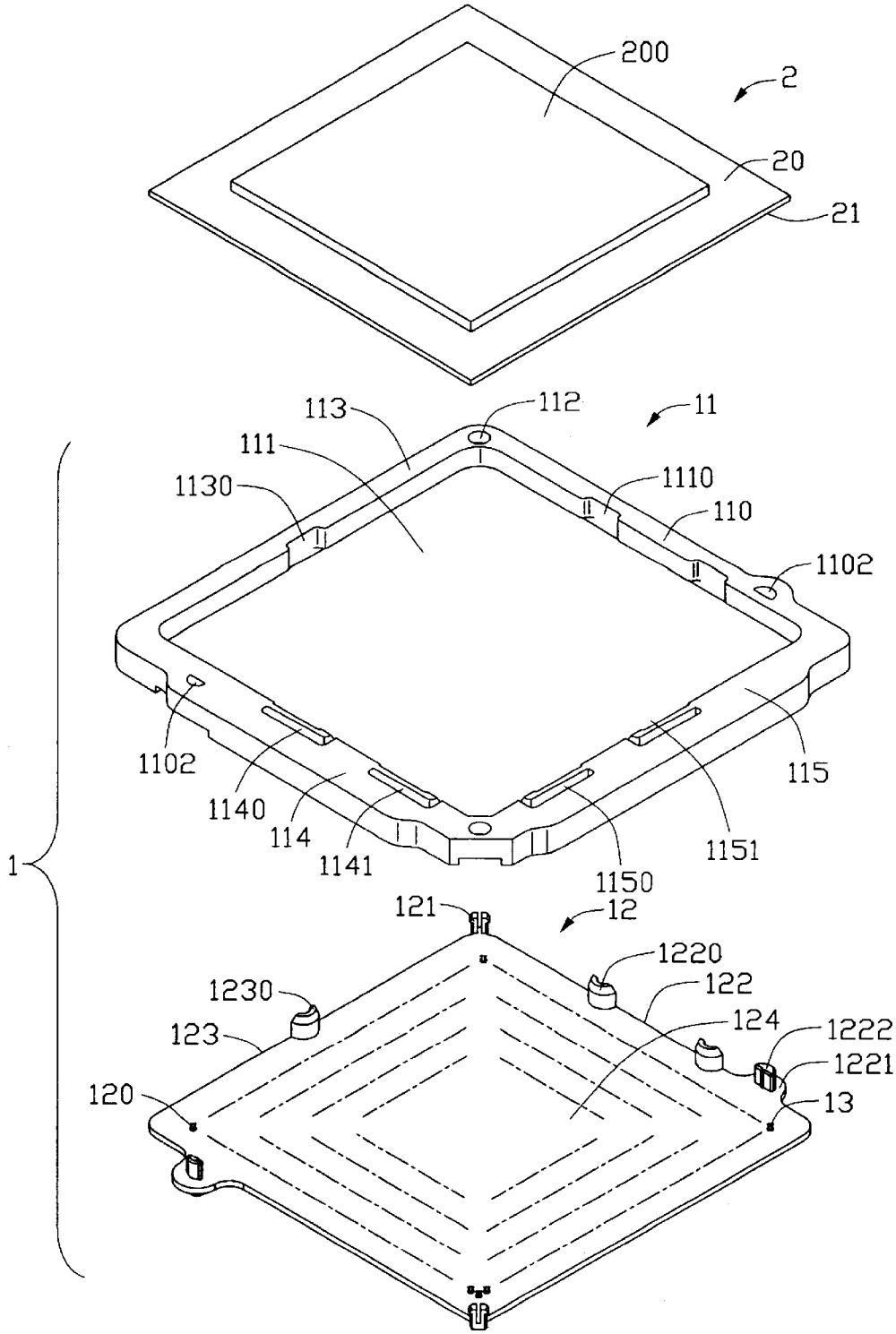
FIG. 1 is a simplified, exploded isometric view of an LGA electrical connector in accordance with a preferred embodiment of the present invention, together with an LGA chip.
Figure 2:
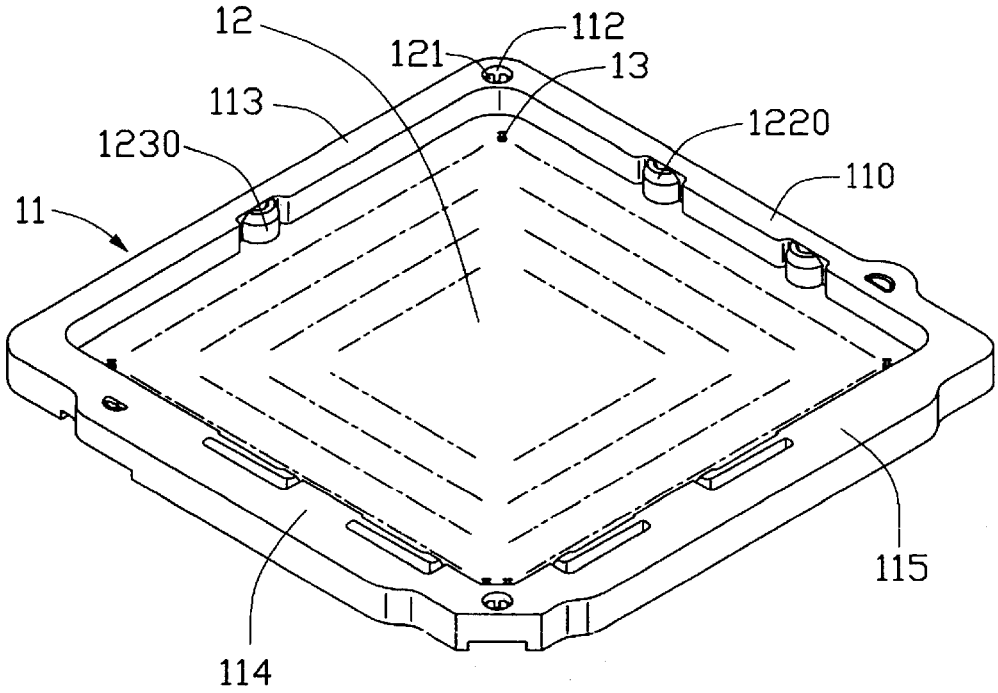
FIG. 2 is an assembled view of the LGA electrical connector of FIG. 1.

Referring to FIGS. 1 and 2, an LGA electrical connector 1 in accordance with a preferred embodiment of the present invention comprises an insulative housing 12, a frame 11 engaged with the housing 12, and a multiplicity of terminals 13 received in the housing 12. An LGA chip 2 comprises a top surface 20 and a bottom surface 21 opposite from the top surface 20. A multiplicity of pins (not shown) depends from the bottom surface 21, for engaging with the terminals 13 of the connector 1. A raised heat sink portion 200 is formed at a middle of the top surface 20, for contacting a heat sink (not shown).

The housing 12 is formed by molding, and is substantially rectangular. The housing 12 defines two opposite first sides 122, two opposite second sides 123 interconnecting the first sides 122, and a flat base 124 disposed between the first and second sides 122, 123. The base 124 defines a space thereabove for receiving the LGA chip 2 thereon. The base 124 defines a multiplicity of terminal passageways 120 in a rectangular array, for interferentially receiving corresponding terminals 13 therein. One of the first sides 122 has two spaced first protrusions 1220 formed thereon, and one of the second sides 123 has a second protrusion 1230 formed thereon. A cross-section of each of the first and second protrusions 1220, 1230 is arcuate. Upper portions of the first and second protrusions 1220, 1230 are beveled, with the bevels facing generally toward a middle of the housing 12. In addition, the first and second protrusions 1223, 1230 can elastically deform. Thus the LGA chip 2 can be guidably fixed between the first protrusions 1220 and the second protrusion 1230. Two bifurcated latches 121 are formed on two diagonally opposite corners of the base 124, such that one of the latches 121 is between the second protrusion 1230 and the first protrusions 1220. Two extension portions 1221 extend coplanarly outwardly from the two opposite first sides 122 respectively. The extension portions 1221 are offset relative to each other such that they are substantially diagonally opposite each other. Two alignment posts 1222 are formed at the extension portions 1221 respectively. Each alignment post 1222 integrally spans from above a top face of the extension portion 1221 to below a bottom face of the extension portion 1221. The alignment posts 1222 are for engagingly fixing the connector I on a PCB (not shown).

The frame 11 comprises a raised first sidewall 110, a raised second sidewall 113, a raised third sidewall 114 and a raised fourth sidewall 115. A central cavity, 111 is defined between the four sidewalls 110, 113, 114, 115, and is sized to receive the housing 12. Cutouts 1110, 1130 are defined in respective inner faces of the first and second sidewalls 110, 113, corresponding to the first and second protrusions 1220, 1230 respectively. Two holes 112 are defined in two diagonally opposite corners of the frame 11, corresponding to the latches 121. Apertures 1102 are respectively defined in the first and third sidewalls 110, 114, corresponding to the alignment posts 1222 of the extension portions 1221. Two spring members 1140, 1141 are formed at inside faces of the third sidewall 114. Two spring members 1150, 1151 are formed at inside faces of the fourth sidewall 115.

In assembly of the connector 1, the terminals 13 are inserted into the terminal passageways 120 along a direction that is perpendicular to the base 124 of the housing 12. The frame 11 is mounted on the housing 12. The latches 121 are engagingly received in the holes 112, the first protrusions 1220 and the second protrusion 1230 are engagingly received in the corresponding cutouts 1100, 1130, and the alignment posts 1222 are engagingly received in the apertures 1102. Thus, assembly of the LGA connector 1 is completed. Because the first and second protrusions 1220, 1230 are arcuate, less material is needed for making the housing 12. This reduces manufacturing costs, and makes the connector 1 lighter. This accordingly reduces transportation costs of the connector 1.

Figure 3:
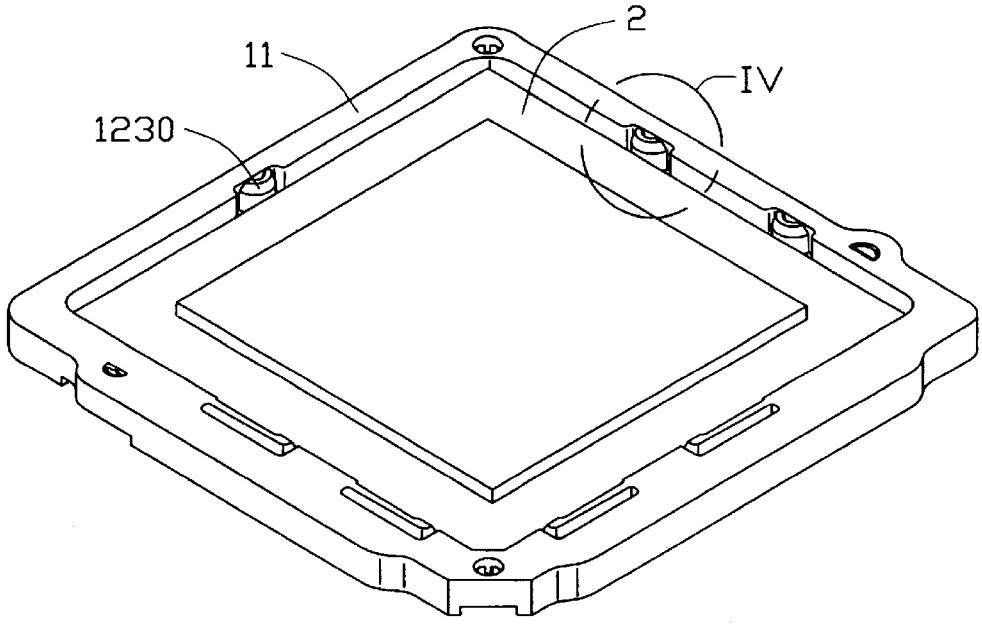
FIG. 3 is an assembled view of FIG. 1.
Figure 4:
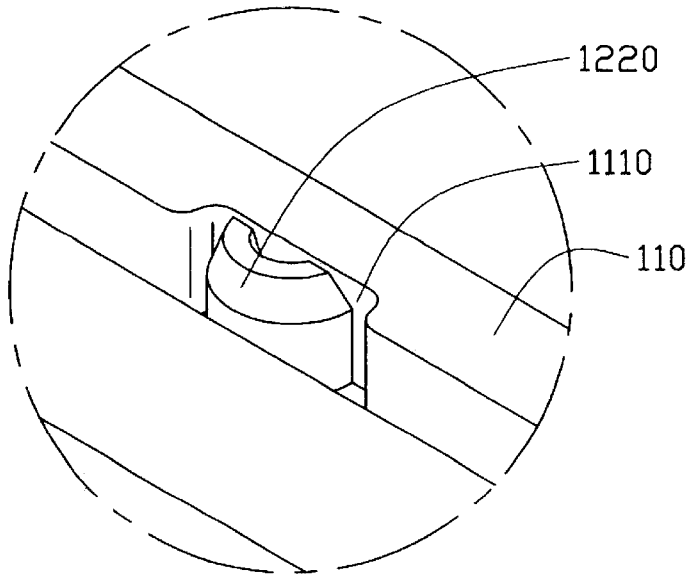
FIG. 4 is an enlarged view of a circled portion IV of FIG. 3.
Figure 5:
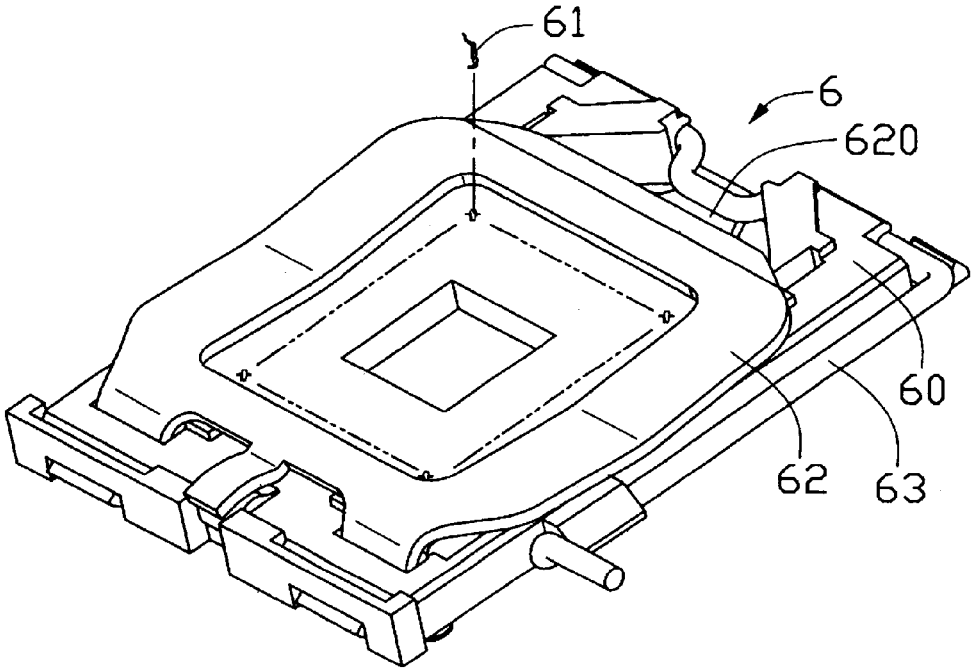
FIG. 5 (PRIOR ART)
FIG. 5 is a simplified, exploded isometric view of a conventional LGA electrical connector.
Figure 6:
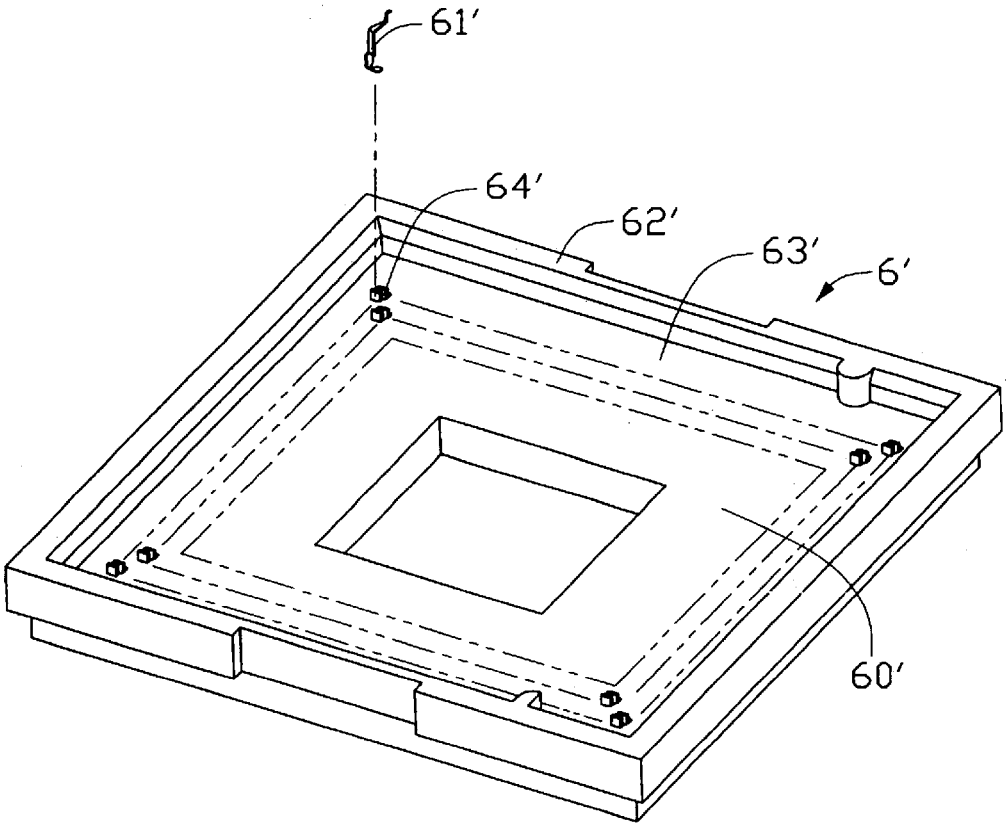
FIG. 6 (PRIOR ART)
FIG. 6 is a simplified, exploded isometric view of another conventional LGA electrical connector.

Referring to FIGS. 3 and 4, the LGA chip 2 is then pushed onto the housing 12 of the connector 1. The pins of the LGA chip 2 are engaged with the terminals 13, thus connecting the LGA chip 2 with the connector 1. The first protrusions 1220 of the first side 122, the second protrusion 1230 of the second side 123, and the alignment posts 1222 of the first sides 1220 cooperate to precisely fittingly position the LGA chip 2 therebetween. The first and second protrusions 1220, 1230 and the spring members 1140, 1141, 1150, 1151 elastically deform when the LGA chip 2 engages with the connector 1. This ensures that the engagement between the terminals 13 and pins of the LGA chip 2 is accurate and reliable. The first and second protrusions 1220, 1230 enable the LGA chip 2 to be quickly and conveniently guided into its correct position in the space above the base 124 of the housing 12.

While a preferred embodiment in accordance with the present invention has been shown and described, equivalent modifications and changes known to persons skilled in the art according to the spirit of the present invention are considered within the scope of the present invention as defined in the appended claims.

What is claimed is:

1. An electrical connector for connecting an electronic package with a circuit substrate, the electrical connector comprising:

an insulative housing defining a space thereabove for receiving the electronic package;

a rectangular frame engaged with the housing and mounted on the circuit substrate, the frame comprising four sidewalls, at least two of the sidewalls each defining a cutout in inner faces of the frame; wherein the housing defines a plurality of edge, at least two of the edges each having a protrusion thereat, the protrusion being received in the cutout; and the cutout enlarges the periphery of the space, whereby the protrusion elastically deform to contact and engage the electronic package in the electrical connector.

2. The electrical connector as claimed in claim 1, wherein a cross-section of each of the protrusion is arcuate.

3. The electrical connector as claimed in claim 1, wherein upper portions of the protrusion are beveled, with bevels facing generally toward a middle of the housing.

4. The electrical connector as claimed in claim 1, wherein two latches are provided on two diagonally opposite corners of the housing.

5. An electrical connector assembly, comprising:

an insulative housing defining a space thereabove for receiving the electronic package; and a rectangular frame mounted to the housing and the frame having four raised sidewalls, at least two of the sidewalls together defining a plurality of cutouts in respective inner faces thereof;

wherein the housing further defines at least two edges having a plurality of protrusions arranged thereat, the protrusions being engagingly received in the cutouts of the frame and partially protruding beyond the inner faces into the space.

6. The electrical connector assembly as claimed in claim 5, wherein a cross-section of each of the protrusions is arcuate.

7. The electrical connector assembly as claimed in claim 5, wherein upper portions of the protrusions are beveled, with bevels facing generally toward a middle of the housing.

8. An electrical connector assembly comprising;

a housing defining a mating face thereon and a plurality of resiliently deformable protrusions at two edges thereof;

a frame fixed to the housing and being substantially rectangular and including four raised sidewalls, a plurality of cutouts defined in inner faces of two of the sidewalls and receiving the protrusions therein; and an electronic component located above the mating face of the housing; wherein the protrusions of the housing physically contact and position the electronic component between the sidewalls of the frame.

9. The electrical connector assembly as claimed in claim 8, wherein a cross-section of each of the protrusions is arcuate.

10. The electrical connector assembly as claimed in claim 8, wherein upper portions of the protrusions are beveled, with bevels facing generally toward a middle of the housing.

* * * * *